US008695848B2

(12) United States Patent
Cook et al.

(10) Patent No.: US 8,695,848 B2
(45) Date of Patent: Apr. 15, 2014

(54) ANGLED TISSUE CARTON

(75) Inventors: Stephen Bradford Cook, Appleton, WI (US); Cornelius Jacobus Bosselaar, Appleton, WI (US); Brian James Ludka, Neenah, WI (US); Duane R. Pingel, Shiocton, WI (US)

(73) Assignee: Kimberly-Clark Worldwide, Inc, Neenah, WI (US)

( * ) Notice: Subject to any disclaimer, the term of this patent is extended or adjusted under 35 U.S.C. 154(b) by 1236 days.

(21) Appl. No.: 11/413,475

(22) Filed: Apr. 28, 2006

(65) Prior Publication Data

US 2007/0262086 A1 Nov. 15, 2007

(51) Int. Cl.
*B65D 5/00* (2006.01)
*A47F 1/04* (2006.01)

(52) U.S. Cl.
USPC ..... 221/305; 206/436

(58) Field of Classification Search
USPC ..... 221/1–312 C, 305; 206/436
See application file for complete search history.

(56) References Cited

U.S. PATENT DOCUMENTS

| | | | | |
|---|---|---|---|---|
| 1,525,040 | A | 2/1925 | Painter | |
| 1,571,918 | A * | 2/1926 | Barbieri | 206/436 |
| 1,889,985 | A | 12/1932 | Miller | |
| 1,897,143 | A | 2/1933 | Powell | |
| 2,107,946 | A | 2/1938 | Inman | |
| 2,334,997 | A | 11/1943 | Doll | |
| 2,349,589 | A | 5/1944 | Harrington | |
| 2,502,561 | A * | 4/1950 | Ebert | 206/750 |
| 2,633,986 | A * | 4/1953 | Vogt | 206/436 |
| 2,807,403 | A | 9/1957 | Joseph | |
| 2,935,192 | A | 5/1960 | De Million-Czamecki | |
| 2,947,637 | A * | 8/1960 | Fobiano | 426/90 |
| 3,006,527 | A | 10/1961 | Lofquist, Jr. | |
| 3,185,378 | A | 5/1965 | Rosenburg | |
| 3,250,386 | A * | 5/1966 | Boynton | 206/436 |
| 3,295,740 | A | 1/1967 | Hall | |
| 3,339,721 | A * | 9/1967 | Goldstein | 206/583 |
| 3,347,363 | A * | 10/1967 | Dykes et al. | 206/436 |
| 3,395,830 | A | 8/1968 | Buttery | |
| 3,397,771 | A * | 8/1968 | Fogle | 206/750 |
| 3,624,791 | A | 11/1971 | Taub | |
| 3,670,872 | A * | 6/1972 | Rock et al. | 206/745 |
| 3,880,342 | A * | 4/1975 | Longo, Jr. | 229/115 |
| 3,884,348 | A * | 5/1975 | Ross | 206/746 |
| 4,121,752 | A * | 10/1978 | Ravotto et al. | 206/486 |
| 4,553,666 | A * | 11/1985 | Gullikson | 229/112 |
| 4,605,159 | A * | 8/1986 | Harrel | 229/116 |
| 4,856,706 | A * | 8/1989 | Van Der Straten | 229/110 |
| D309,434 | S | 7/1990 | Goldman | |
| 4,969,575 | A | 11/1990 | Kobayashi | |
| 5,118,033 | A | 6/1992 | Kula | |
| 5,125,565 | A | 6/1992 | Rogers | |

(Continued)

FOREIGN PATENT DOCUMENTS

EP 0 587 131 A1 3/1994

*Primary Examiner* — Michael K Collins
(74) *Attorney, Agent, or Firm* — Kimberly-Clark Worldwide, Inc.

(57) ABSTRACT

A product including a shipping box containing a plurality of sheet-material dispensers. The sheet-material dispensers enclose a stack of sheets formed from a sheet-material. The dispenser includes a top, a bottom, a first side wall, and a second sidewall. The first and second sidewall comprising either a triangle, truncated triangle, or a trapezoid. Two or more sheet material dispensers are interrelated within the shipping box to form a substantially parallelepiped shape for efficient shipping.

21 Claims, 14 Drawing Sheets

(56) References Cited

U.S. PATENT DOCUMENTS

| | | | | | |
|---|---|---|---|---|---|
| 5,181,650 | A | * | 1/1993 | Hollander et al. | 206/746 |
| 5,215,757 | A | | 6/1993 | El Nokaly | |
| 5,259,550 | A | | 11/1993 | Kuchenbecker | |
| 5,358,172 | A | * | 10/1994 | Hollander et al. | 229/103 |
| 5,516,000 | A | | 5/1996 | Freiburger et al. | |
| D376,501 | S | | 12/1996 | Spaseska | |
| 5,599,555 | A | | 2/1997 | El Nokaly | |
| D378,330 | S | | 3/1997 | Spaseska | |
| 5,881,884 | A | * | 3/1999 | Podosek | 206/774 |
| 5,921,398 | A | * | 7/1999 | Carroll | 206/736 |
| 5,927,498 | A | * | 7/1999 | Saam | 206/499 |
| 5,980,931 | A | | 11/1999 | Fowler et al. | |
| 6,024,323 | A | | 2/2000 | Palermo, Jr. | |
| 6,121,165 | A | | 9/2000 | Mackey et al. | |
| D442,083 | S | | 5/2001 | Hoffman et al. | |
| 6,244,501 | B1 | * | 6/2001 | Choi | 229/120.01 |
| D463,976 | S | | 10/2002 | Sipinen et al. | |
| D494,859 | S | * | 8/2004 | Keberlein | D9/416 |
| 7,021,468 | B2 | * | 4/2006 | Cargile, Jr. | 206/746 |
| 7,225,930 | B2 | * | 6/2007 | Ford et al. | 206/746 |
| D591,172 | S | * | 4/2009 | Keberlein et al. | D9/756 |
| D591,618 | S | * | 5/2009 | Keberlein et al. | D9/756 |
| 2003/0102243 | A1 | * | 6/2003 | Sab | 206/494 |
| 2004/0074956 | A1 | * | 4/2004 | Sax et al. | 229/211 |
| 2005/0000976 | A1 | * | 1/2005 | Keberlein | 221/63 |
| 2006/0049074 | A1 | | 3/2006 | Long et al. | |

* cited by examiner

ANGLED TISSUE CARTON

BACKGROUND

Increasingly, producers of consumer product dispensers, such as facial tissue cartons, are interested in alternative shapes besides the typical parallelepiped shapes generally offered. A parallelepiped (rectangular prism) can offer several advantages such as efficient packing of the product, efficient distribution of the product, and efficient board utilization to make the carton. However, consumers have grown accustomed to such shapes and there is little differentiation from one product to another. Graphical treatments can help, but the basic dispenser shapes are still largely the same for all manufacturers.

Alternatively shaped dispensers could offer an advantage in product differentiation. However, such shaped dispensers are typically not sized or shaped for efficient utilization of the standard shipping corrugate or box, and ultimately the pallet on which typical rectangular facial tissue dispensers are shipped for sale. This can significantly increase product distribution costs, which are passed on to customers, making potential alternative dispenser shapes more expensive for retailers and consumers alike and therefore potentially less desirable.

Therefore, a need exists for dispenser shapes that are significantly differentiated from the typical rectangular shape, yet, at the same time, can be fit together such that they can fill a standard shipping box with little or no waste, thereby minimizing distribution costs while providing unique, advantaged shapes and designs.

SUMMARY

The inventors have discovered that by forming a sheet-material dispenser with one or more angles of 45 degrees formed by two sides of the dispenser, and all the remaining angles either 90 degrees or 135 degrees, 2 or more individual sheet dispensers can be grouped to form a parallelepiped. The overall shape of each sheet-material dispenser and the grouping that forms the parallelepiped are such that efficient packing of a shipping box is achieved. This can additionally provide the benefits of internal strength and support to the shipping box in which they are placed, and help to protect the dispensers from structural damages or excessive surface abrasion. Thus, with efficiently packed shipping boxes stacked efficiently on a pallet, supply chain costs can be minimized.

Hence, in one aspect, the invention resides in a product including: a shipping box containing a plurality of sheet-material dispensers; the sheet material dispensers housing a stack of sheets formed from a sheet-material, the dispenser comprising a top, a bottom, a first side wall, and a second sidewall, the first and second sidewalls comprising either a triangle, a truncated triangle, or a trapezoid; and wherein two or more sheet material dispensers are interrelated within the shipping box to form a substantially parallelepiped shape.

BRIEF DESCRIPTION OF THE DRAWINGS

The above aspects and other features, aspects, and advantages of the present invention will become better understood with regard to the following description, appended claims, and accompanying drawings in which:

Figure 1B:
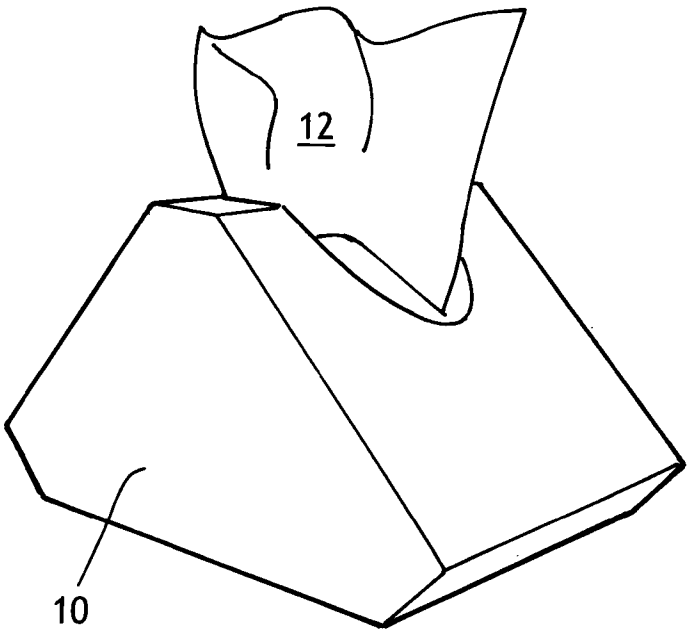
FIGS. 1A-1D illustrate several alternative embodiments of the sheet-material dispenser in accordance with the invention in perspective view.

Repeated use of reference characters in the specification and drawings is intended to represent the same or analogous features or elements of the invention in different embodiments.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet-material" is a flexible substrate, which is useful for household chores, cleaning, personal care; health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; shop towels; and metal substrates such as aluminum foil. Furthermore, laminated or plied together substrates of two or more layers of any of the preceding substrates are also suitable.

As used herein, "wet sheet-material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate, issued to Fowler et al. on Nov. 9, 1999. Other suitable wet sheet-materials can have encapsulated ingredients such that the capsules rupture during dispensing or use. Examples of encapsulated materials include those disclosed in U.S. Pat. No. 5,215,757 entitled Encapsulated Materials, issued to El-Nokaly on Jun. 1, 1993, and U.S. Pat. No. 5,599,555 entitled Encapsulated Cosmetic Compositions, issued to El-Nokaly on Feb. 4, 1997. Other suitable wet sheet-materials include dry substrates that deliver liquid when subjected to in-use shear and compressive forces. Such substrates are disclosed in U.S. Pat. No. 6,121,165 entitled Wet-Like Cleaning Articles, issued to Mackay et al. on Sep. 19, 2000. Other suitable wet sheet-materials include those having a formulation that can be heated in a microwave oven to create a warm wet wipe.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Referring to FIGS. 1A-1D, four alternative dispensers 10, 10', 10" and 10''' for sheets 12 of sheet-materials in accordance with the present invention are illustrated. Each of the dispensers has at least one surface at a 45 degree angle such that when two or more dispensers are interrelated, a substantially parallelepiped shape is formed. Thus, when separated, the dispensers have a unique and visually appealing shape; but when packed for shipping, the dispensers nest together to form a substantially parallelepiped shape. As such, efficient distribution of the dispensers in corrugates or shipping boxes that are placed onto a standard shipping pallet with a high efficiency is possible. Alternatively, the shipping boxes can be stacked and shrink wrapped to have an approximate 48" by 40" inch footprint for loading into an enclosed semi-trailer.

Figure 1A:
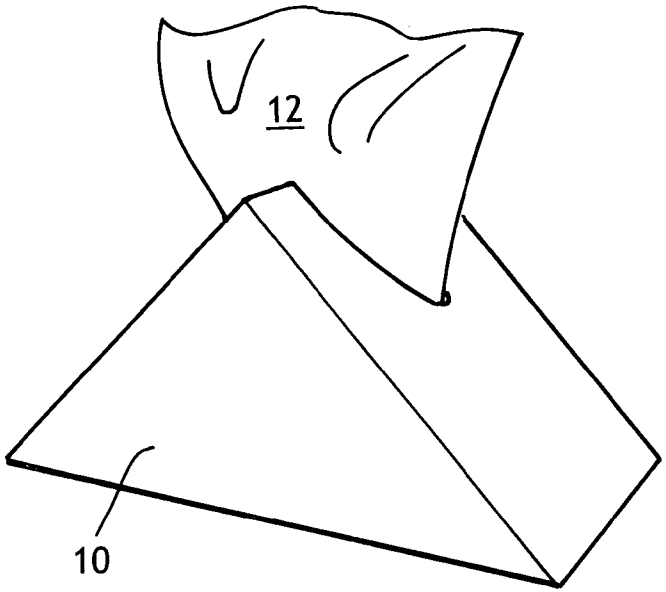
Figure 2B:
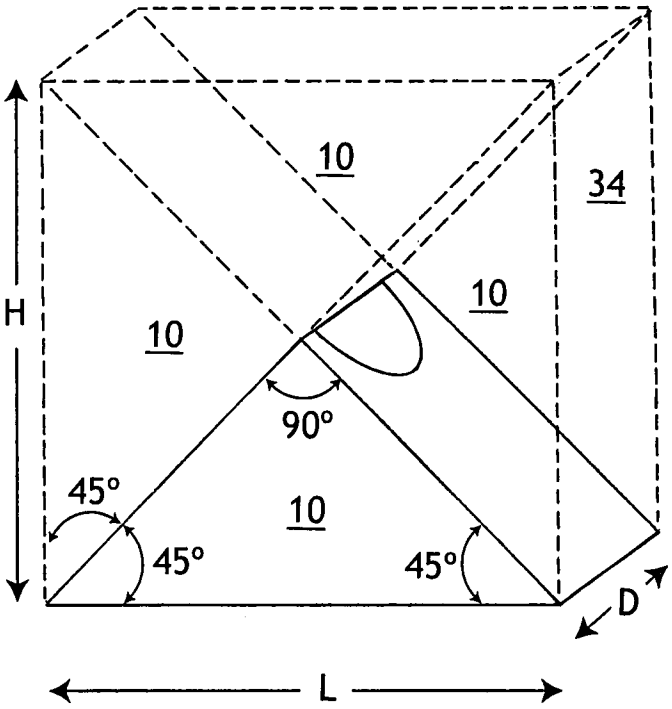
FIGS. 2A-2C illustrate a front view of the dispenser in FIG. 1A, a blank for making the dispenser, and one possible packing configuration.
Figure 2A:
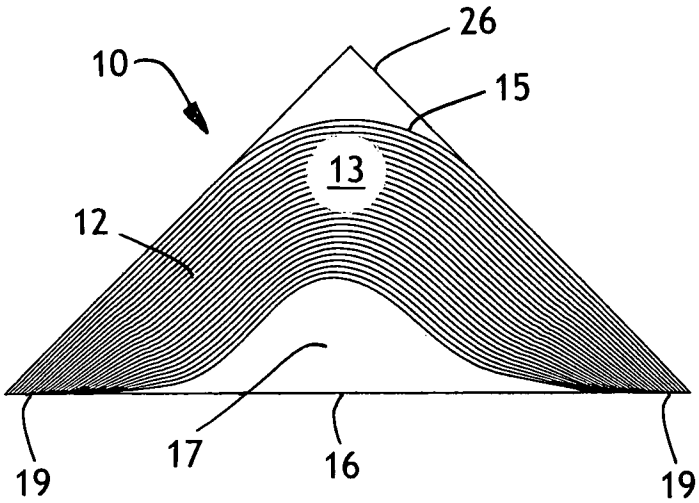
Figure 2C:
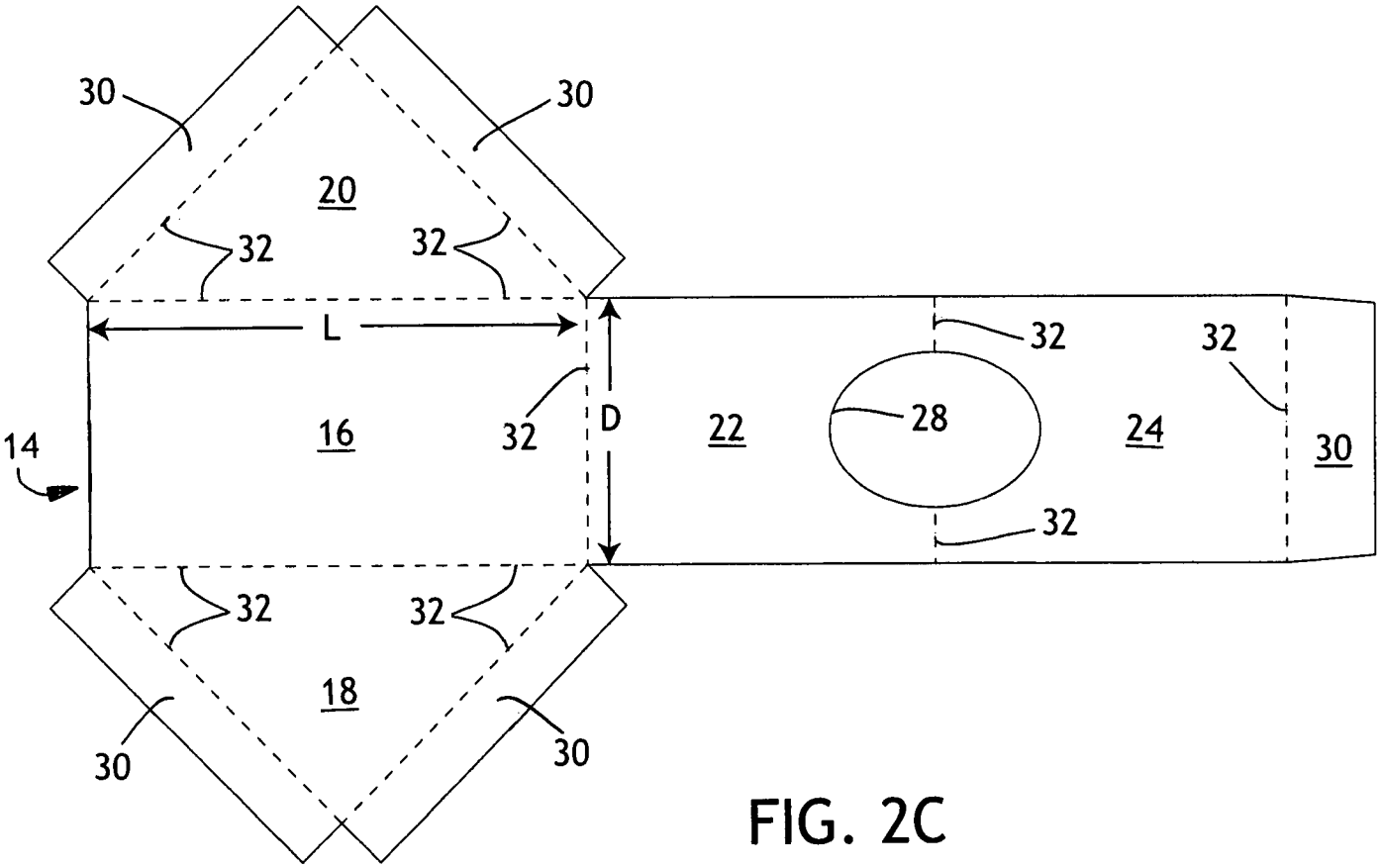

Referring now to FIGS. 2A-2C, a front view of the dispenser in FIG. 1A, a blank for making the dispenser, and a packing configuration are illustrated. The dispenser 10 includes a triangular shape housing a plurality of sheets 12 formed from a sheet-material. The sheets can be interfolded for pop-up dispensing and formed into a stack 13. Unlike prior upright dispensers, the stack 13 is not U-shaped, but instead comprises an arched or ramped shape 15. Depending on the length of the dispenser, the stack 13 may have an opening 17 with a profile similar to a statistical bell-shaped curve in the center. The stack 13 has a pair of flared legs 19, similar to the rim of a bell, which point towards the dispenser's sloped sides instead of the bottom 16 when disposed within the dispenser 10. A portion of the flared legs 19 lie flat or parallel to the bottom 16. This type of stack configuration hereinafter is referred to as bell-shaped. The bell-shaped stack can dispense better than a standard U-shaped stack (FIG. 4A) since the sides of the stack may not be as compressed by the sides of the dispenser. This can reduce dispensing problems, such as sheet tears, when the dispenser is full or nearly full of facial tissue sheets. Alternately, the sheets can be folded or formed into a stack 13 without interfolding for reach-in dispensing.

The carton blank 14 includes a rectangular bottom 16, a first triangular sidewall 18, a second triangular sidewall 20, a first dispensing panel 22, and a second dispensing panel 24. The first and second dispensing panels (22, 24) form a top 26 of the carton. A dispensing opening 28 can be located partially in both the first and second dispensing panels (22, 24) such that it is located symmetrically about the peak of the triangular carton on the top 26. Alternatively, the dispensing opening 28 can be located in any other convenient location of the carton's top.

The bottom 16 has a length, L, that can be adjusted to change the profile of the bell-shaped stack 13 for different sheet counts, dispenser sizes, or for improved dispensing with less clip compression. For a standard facial tissue sheet that is approximately 8.4 inches in length, the length L can be between about 5 inches to about 9 inches, or between about 5.5 inches to about 8 inches, or between about 6.5 to about 7.7 inches. A V-folded standard facial tissue sheet is approximately 4.25 inches wide. Thus, the depth D of the carton can be between about 4.25 inches to about 4.75 inches. Differently sized sheet-materials can utilize different ranges for the length L and depth D to assist in forming the bell-shaped stack 13.

The carton blank 14 also can include a plurality of tabs 30 for joining the various panels to form the dispenser 10. To form the triangular dispenser 10, the carton blank 14 is folded about a plurality of fold lines 32, and the tabs 30 are secured to the interior portions of the various panels using an adhesive. Other construction techniques known to those of skill in the art of carton construction can be used to form the dispenser 10.

Figure 6A:
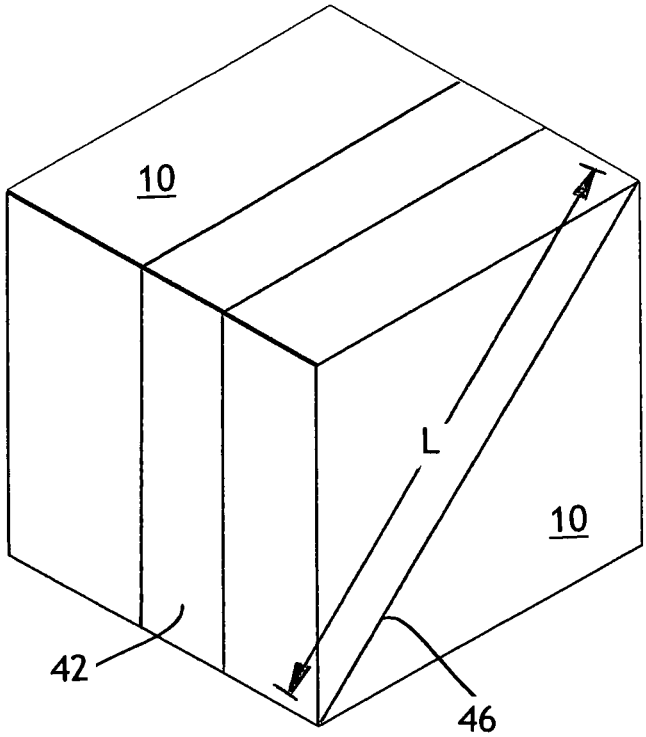
FIGS. 6A-6C illustrate a second packing configuration, a plurality of sheet-material dispensers in a shipping box, and the shipping boxes arranged into a pallet volume.
Figure 7A:
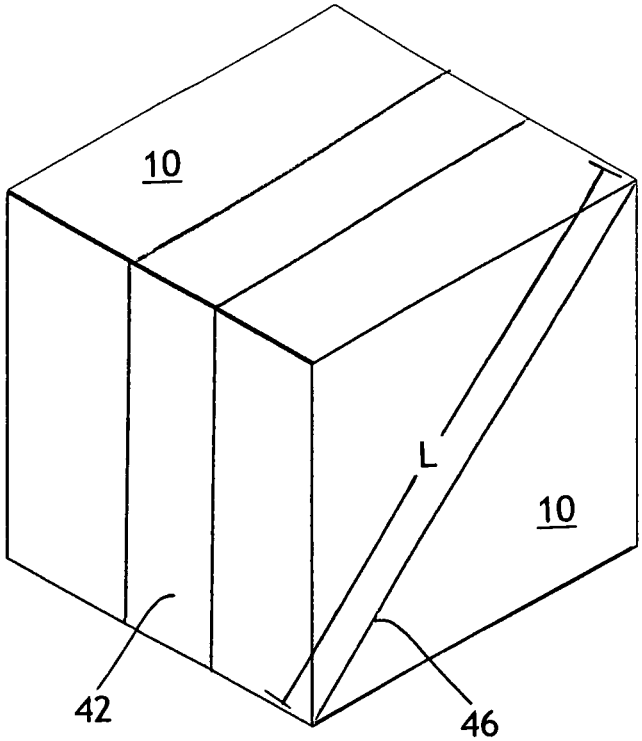
FIGS. 7A-7C illustrates a second packing configuration, a plurality of sheet-material dispensers in a shipping box, and the shipping boxes arranged into a pallet volume.

The panels forming the triangular dispenser 10 are configured such that the first dispensing panel 22 intersects with the bottom 16 to form a 45 degree angle, the second dispensing panel 24 intersects with the bottom 16 to form another 45 degree angle, and the first dispensing panel 22 intersects with the second dispensing panel to form a 90 degree angle forming an isosceles triangle. As such, when four isosceles triangular dispensers 10 are interrelated, a substantially parallelepiped shape 34 is formed having a height (equal to L), H, a length, L, and a depth, D. Alternatively, two isosceles triangular dispensers can be interrelated to form a smaller parallelepiped by placing the bottoms 16 of two dispensers adjacent to each other (FIGS. 6A, 7A). When the dispensers are thus packed into a standard shipping box, the fill efficiency of the dispensers in the shipping box can be 100 percent since there is no wasted space. Contrast this fill efficiency with an equilateral triangular-shaped tissue carton, as shown in U.S. patent application 2005/0000976 entitled Wedged Tissue Container by Keberlein, and the stacking configuration shown in FIGS. 7 and 8 of the patent application. The stacking configuration of FIG. 7 is calculated to have a fill efficiency of approximately 75 percent since there is a significant amount of wasted space when multiple hexagonal shapes are placed into a rectangular shipping box.

Figure 3B:
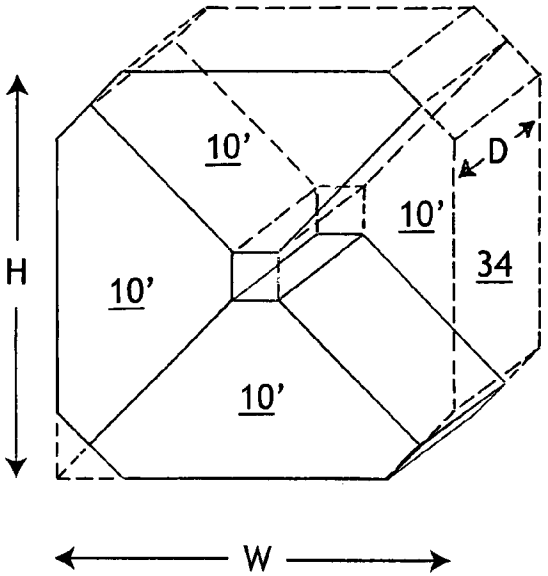
FIGS. 3A-3D illustrate a front view of the dispenser in FIG. 1B, a blank for making the dispenser, and one possible packing configuration.
Figure 3D:
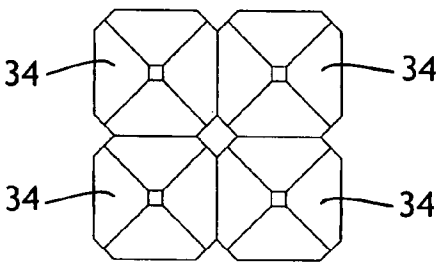
Figure 3A:
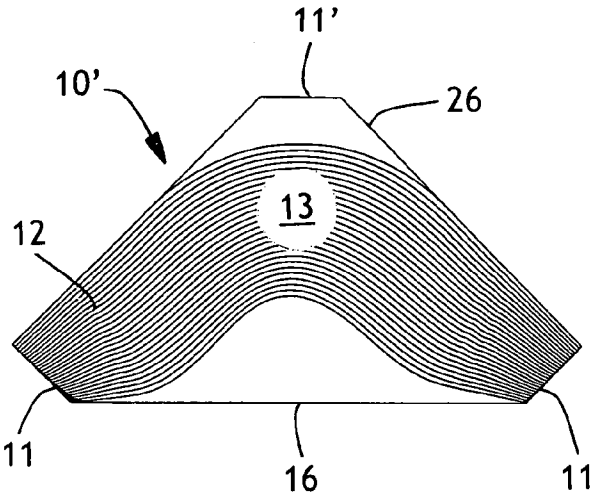
Figure 3C:
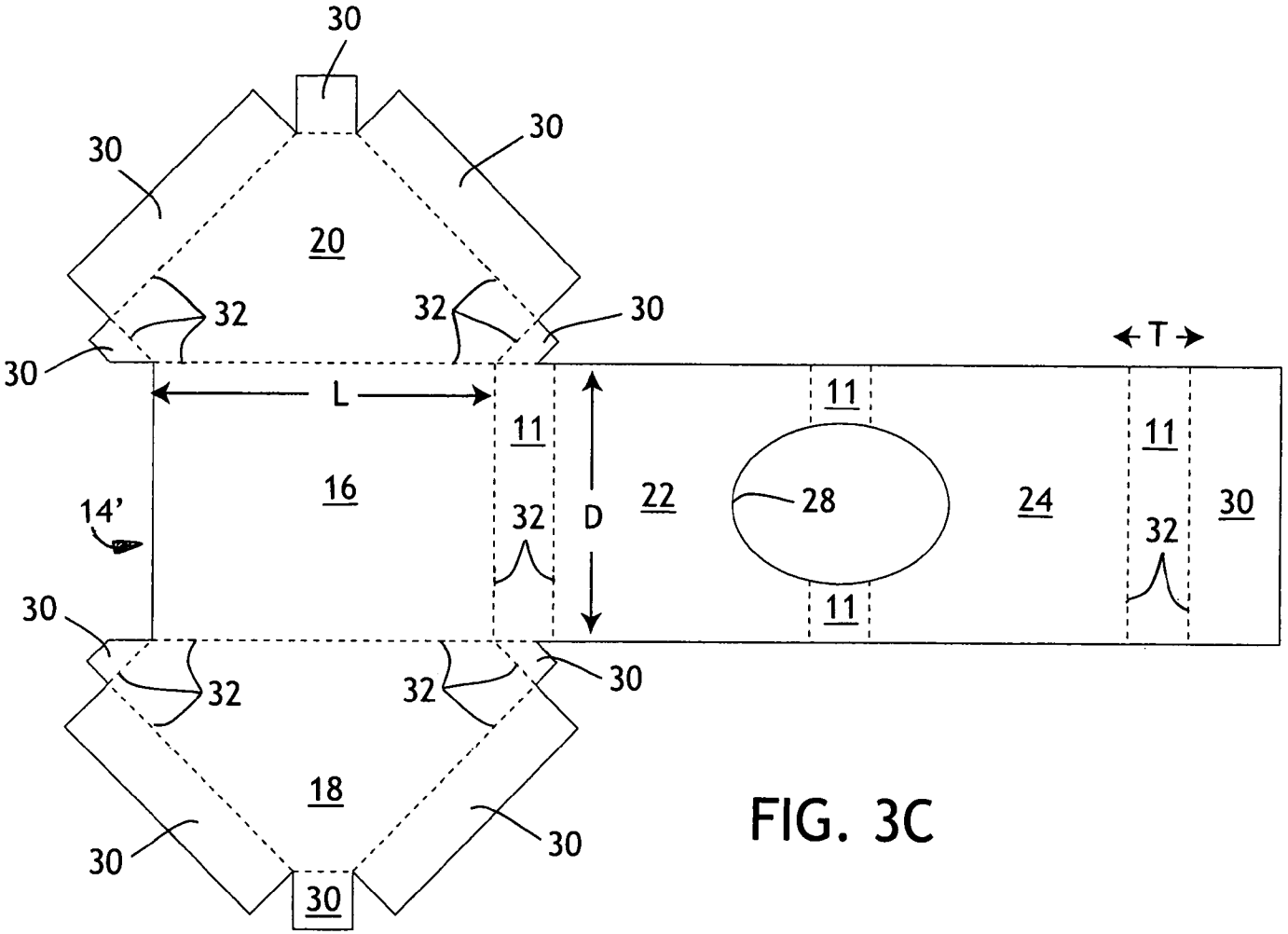

Referring now to FIGS. 3A-3C, a front view of the dispenser in FIG. 1B, a blank for making the dispenser, and a packing configuration are illustrated. The dispenser 10' includes a truncated triangular shape having one or more corners with an edge panel 11. The dispenser 10' houses a plurality of sheets 12 formed from a sheet-material. The sheets can be interfolded for pop up dispensing and formed into a stack 13. Unlike prior upright containers, the stack is not U-shaped, but instead comprises a bell-shaped stack 13. The bell-shaped stack 13 can dispense better than a standard U-shaped stack as previously discussed. Alternately, the sheets can be folded or formed into a stack 13 without interfolding for reach-in dispensing.

The carton blank 14' includes a rectangular bottom 16, a first truncated triangular sidewall 18', a second truncated triangular sidewall 20', a first dispensing panel 22, a second dispensing panel 24, and three edge panels 11. The first and second dispensing panels (22, 24) and the top edge panel 11' form a top 26 of the carton 10'. A dispensing opening 28 can be located partially in the first and second dispensing panels (22, 24) and partially in the edge panel 11' such that it is located symmetrically about the edge panel 11' on the top 26 of the truncated triangular dispenser 10'. Alternatively, the dispensing opening 28 can be located in any other convenient location on one or more panels (22, 24, 11') forming the dispenser's top 26.

The bottom 16 has a length, L, that can be adjusted to change the profile of the bell-shaped stack 13 for different sheet counts, dispenser sizes, or for improved dispensing with less stack compression. For a standard facial tissue sheet that is approximately 8.4 inches in length, the length L can be between about 4.5 inches to about 8 inches, or between about 5.5 inches to about 7.5 inches. A V-folded standard facial tissue sheet is approximately 4.25 inches wide. Thus, the depth D of the carton can be between about 4.25 inches to about 4.75 inches. In various embodiments of the invention, the truncation length, T, for the length of the edge panel 11 can be between about 0.5 inch to about 2.5 inches, or between about 1 inch to about 2 inches. Differently sized sheet-materials can utilize different ranges for the length L, truncation length T, and depth D to assist in forming the bell-shaped stack 13.

The carton blank 14' also can include a plurality of tabs 30 for joining the various panels to form the dispenser 10'. To form the truncated triangular dispenser 10', the carton blank 14 is folded about a plurality of fold lines 32, and the tabs 30 are secured to the interior portions of the various panels using an adhesive. Other construction techniques known to those of skill in the art of carton construction can be used to form the dispenser.

The panels forming the truncated triangular dispenser 10' are configured such that the first dispensing panel 22 and the bottom 16 would intersect to from a 45 degree angle if both were extended, the second dispensing panel 24 and the bottom 16 would intersect to form another 45 degree angle if both were extended, and the first dispensing panel 22 and the second dispensing panel 24 would intersect to form a 90 degree angle if both were extended forming a truncated isosceles triangle.

The dispenser 10' is similar to the dispenser in FIG. 1A, except each of the dispenser's triangular corners have been truncated by an edge panel 11. In various embodiments, one, two or all three of the dispenser's corners can be truncated to form a truncated triangular sidewall. For example, only one edge panel 11 may be used and located on any of the corners. In a preferred embodiment, one edge panel 11' is located on the top 26 between the two dispensing panels (22, 24). Thus, the sidewalls (18, 20) would have two 45 degree angles for both bottom corners (un-truncated) and a truncated 90 degree angle for the top corner. In another embodiment with two edge panels 11, both bottom corners of the sidewalls (18, 20) could be truncated and the top corner un-truncated, forming a 90 degree angle. Thus, the sidewalls (18, 20) would have two truncated 45 degree angles at each bottom corner and a 90 degree angle for the top.

As such, when four truncated isosceles triangular dispensers 10' are interrelated, a substantially parallelepiped shape 34' is formed having a height H, a width, and a depth D. Alternatively, two truncated isosceles triangular dispensers 10' can be interrelated to form a smaller generally parallelepiped shape by placing the bottoms 16 of two cartons adjacent to each other (FIGS. 6A, 7A). When the dispensers are thus packed into a standard shipping box, the fill efficiency of the dispensers in the shipping box can be between about 85 percent to about 98 percent depending on the amount of truncation and whether all corners of the triangular carton are truncated. Contrast this fill efficiency with a grouping of equilateral triangular shaped tissue cartons to form a hexagonal as shown in U.S. patent application 2005/0000976 entitled Wedged Tissue Container by Keberlein in FIG. 7, which is calculated to have a fill efficiency of approximately 75.

Figure 1D:
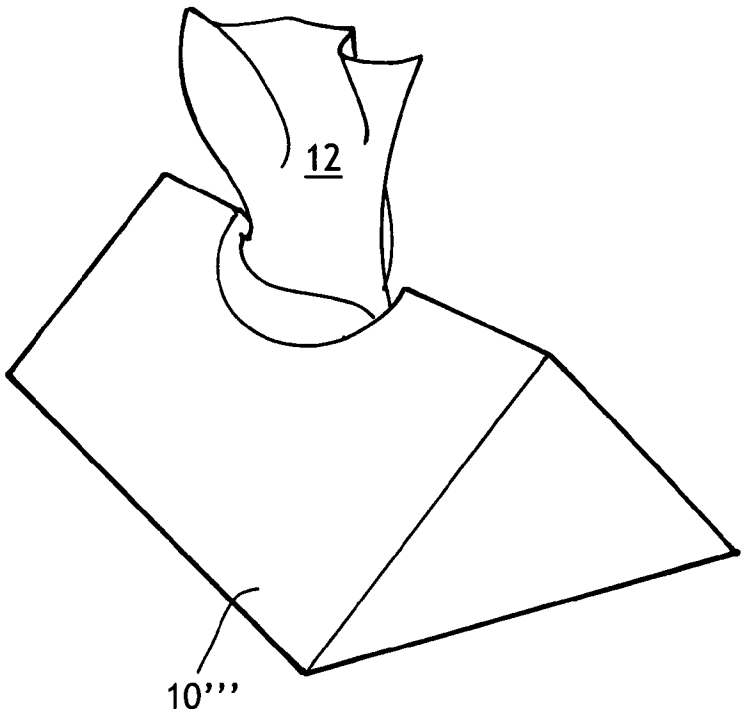
Figure 1C:
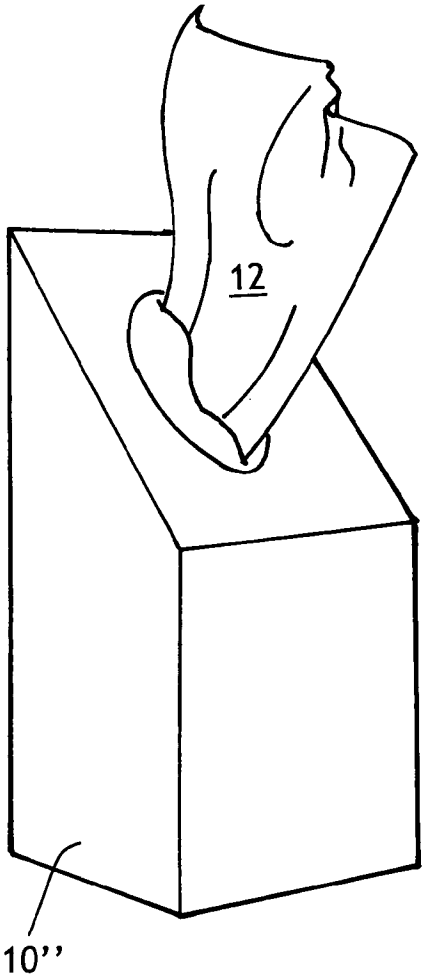
Figure 4B:
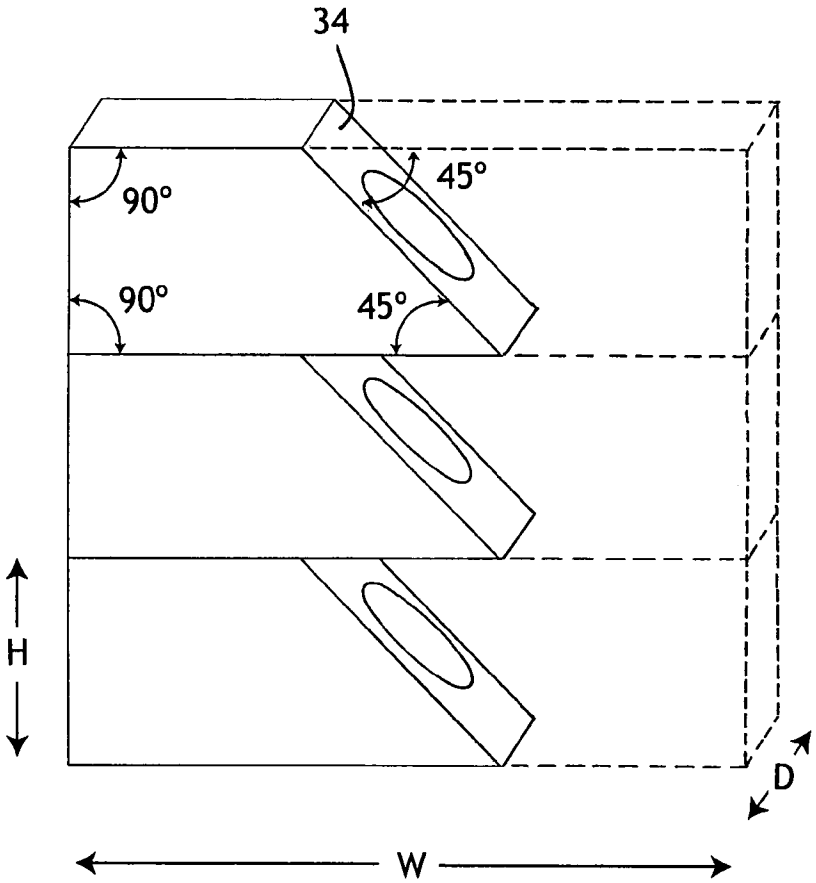
FIGS. 4A-4C illustrate a front view of the dispenser in FIG. 1C, a blank for making the dispenser, and one possible packing configuration.
Figure 4A:
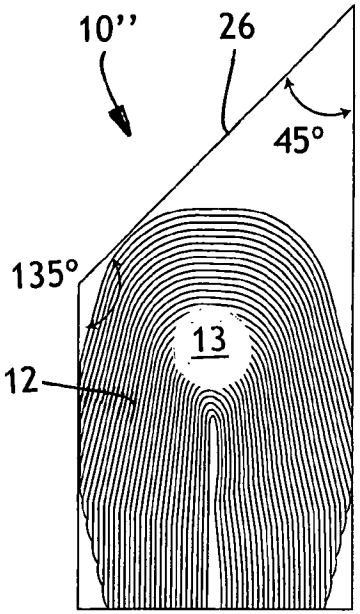
Figure 4C:
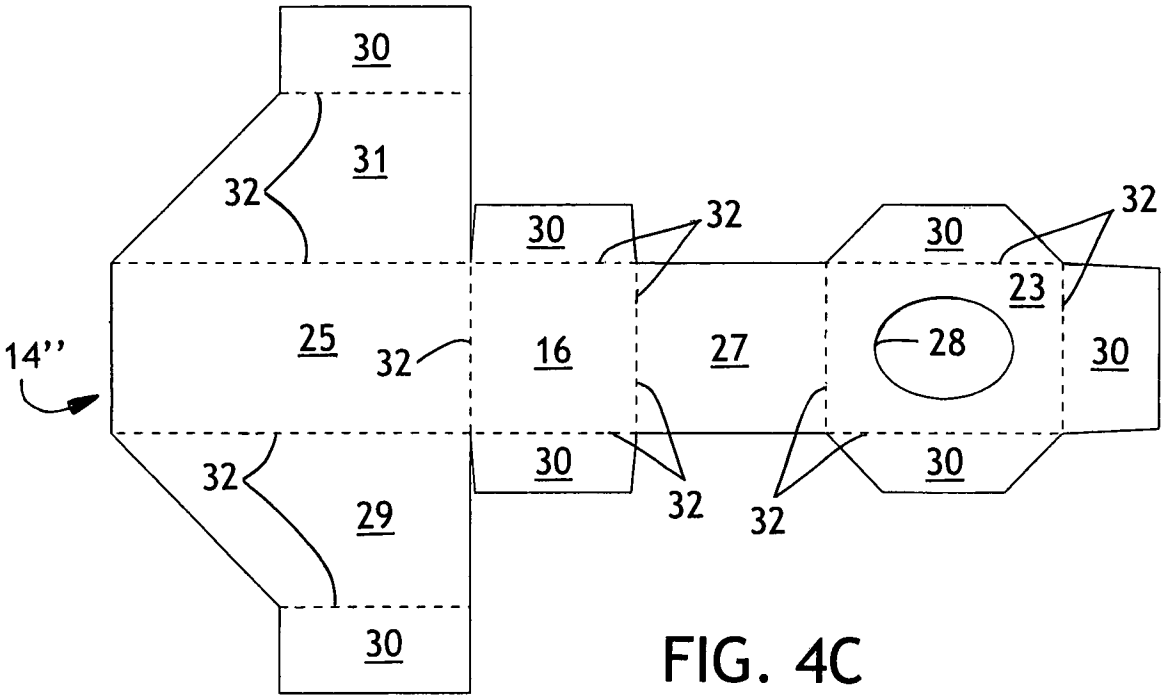

Referring now to FIGS. 4A-4C, a front view of the dispenser in FIG. 1C, a blank for making the dispenser and a packing configuration are illustrated. The dispenser 10" includes a trapezoidal shape housing a plurality of sheets formed from a sheet-material. The sheets can be interfolded for pop-up dispensing and formed into a stack 13 that assumes an upside down U-shape when disposed within the carton 10". Alternately, the sheets can be folded or formed into a U-shaped stack 13 without interfolding for reach-in dispensing. Alternatively, the stack can be folded into a J-shape as disclosed in U.S. patent application Ser. No. 10/933,892 entitled Folded Clip and Dispenser by Long et al. The J-shaped stack can be disposed in the dispenser with the shorter leg adjacent a dispensing panel 23 and the longer leg adjacent a first rectangular sidewall 25 and the bottom 16.

The carton blank 14" includes a rectangular bottom 16, a first rectangular sidewall 25, a second opposing rectangular sidewall 27, a first trapezoidal sidewall 29, and a second opposing trapezoidal sidewall 31, and a rectangular dispensing panel 23. The rectangular dispensing panel 23 forms an angled top 26 of the dispenser 10". A dispensing opening 28 is located in the angled top 26 of the dispenser.

The carton blank 14" also can include a plurality of tabs 30 for joining the various panels to form the carton 10". To form the trapezoidal carton 10", the carton blank 14" is folded about a plurality of fold lines 32, and the tabs 30 are secured to the interior portions of the various panels using an adhesive. Other construction techniques known to those of skill in the art of carton construction can be used to form the carton.

The panels forming the trapezoidal dispenser 10" are configured such that the dispensing panel 23 intersects with the first rectangular sidewall 25 at a 45 degree angle and intersects with the second opposing rectangular sidewall 27 at a 135 degree angle. The remaining panels and corners of the trapezoidal dispenser 10" are 90 degrees. As such, when two trapezoidal dispensers 10" are interrelated, a substantially parallelepiped shape 34 is formed having a height H, a width W, and a depth D. When the dispensers are thus packed into a standard shipping box, the fill efficiency of the dispensers in the shipping box can be 100 percent since there is no wasted space. Alternatively, the first and second trapezoidal sidewalls (29, 31) can be a differently shaped trapezoid. For example, the first and second trapezoidal sidewalls can be selected to provide a different angle for the dispensing panel 23 in relation to the bottom 16.

Figure 5B:
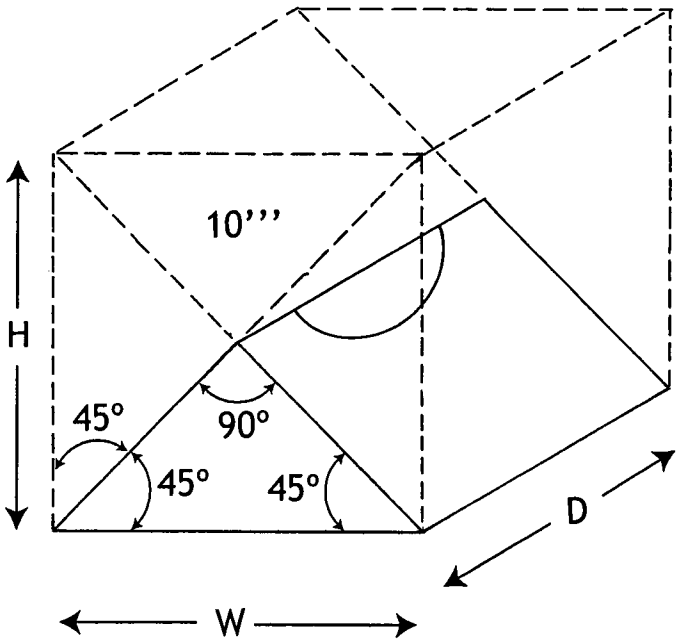
FIGS. 5A-5C illustrate a front view of the dispenser in FIG. 1D, a blank for making the dispenser and one possible packing configuration.
Figure 5A:
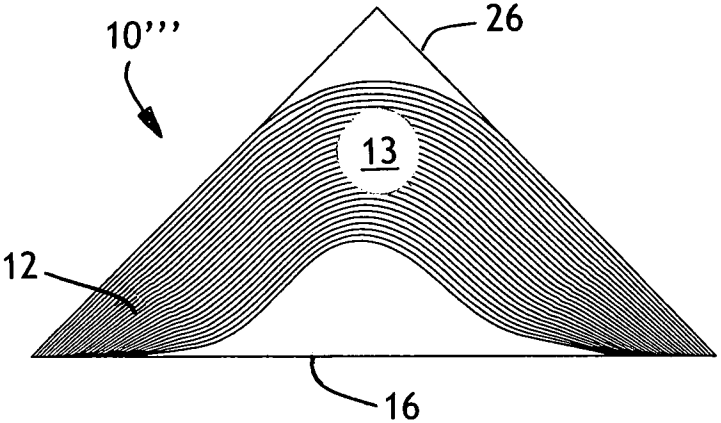
Figure 5C:
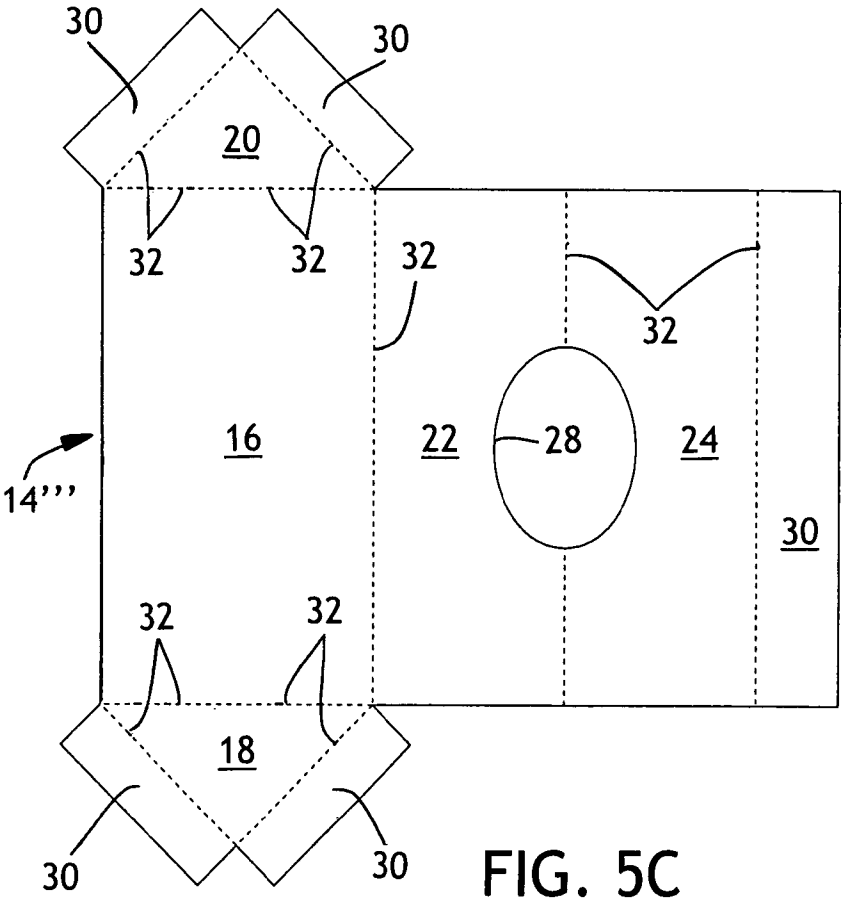

Referring now to FIGS. 5A-5C, a front view of the dispenser in FIG. 1D, a blank 14''' for making the dispenser, and a packing configuration are illustrated. The dispenser 10''' includes a triangular shape housing a plurality of sheets 12 formed from a sheet-material. The dispenser is configured as described for FIGS. 2A-2C, and can include a bell-shaped stack 13 of sheets. In this embodiment, the depth, D, of the dispenser is significantly increased. As such, it is more suitable for stacks having a greater depth. For example, if the dispenser is dispensing a standard facial tissue sheet having a size of approximately 8.4 inches long and 4.25 inches wide, the width, W, of the bottom 16 may be between about 2 inches to about 4 inches to from the bell shaped stack. The depth of the dispenser may be approximately 9 inches long. Thus, the bell-shaped stack 13 of FIG. 2A is formed in the length direction of the stack, while the bell-shaped stack 13 of FIG. 5A is formed in the width direction of the stack. Alternatively, the dispenser can be configured to dispense paper towels formed into a stack, a roll of paper towels, or a roll of another sheet-material by changing the dimensions.

In any of the illustrated embodiments, the dispensing opening 28 can optionally include a dispensing window. The dispensing window can be made from a suitable material such as a film, nonwoven, or paper material that can retain a partially dispensed sheet, such as a facial tissue, within the dispensing opening for pop-up dispensing. The dispensing window can have a dispensing orifice that can be a slit; a curvilinear line; a geometric shape such as an oval, a circle, or a triangle; or X-shaped, +-shaped or H-shaped orifice. Alternatively, the dispensing window can be eliminated and fingers or tabs projecting into the dispensing opening can be used to retain a partially dispensed sheet.

The dispensing opening 28 can be any size or shape such as square, circular, or oval. The dispensing opening generally will be larger in size for a reach-in dispenser and smaller in size for a pop-up dispenser. The dispenser can further include an optional removable surfboard or cover that can be attached to the dispensing panels by a perforated or weakened line. The removable cover can be used to prevent foreign materials from entering the filled dispenser and provides protection for the more fragile dispensing window during loading and shipping. The dispenser can also include an optional film wrapper to further cover the dispensing opening or outer portion of the dispenser. The film wrapper can be used to display printed information, such as a prominent trademark, size of the sheets, the number of sheets, or patent information, which can later be removed by the consumer so as to not detract from the graphic design of the dispenser.

The dispenser can be made from suitable materials that include, without limitation, cardboard, carton stock, paper board, polypropylene, polyethylene, polystyrene, ABS plastic, plastic, metal, wood, and glass, amongst other suitable alternatives.

Figure 6B:
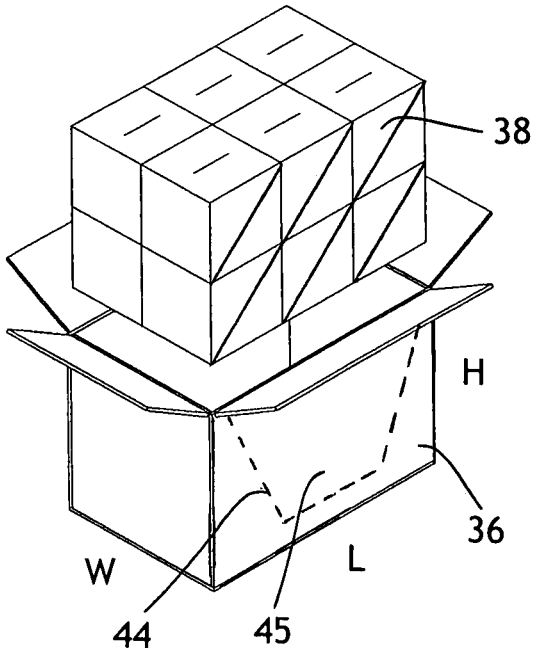
Figure 6C:
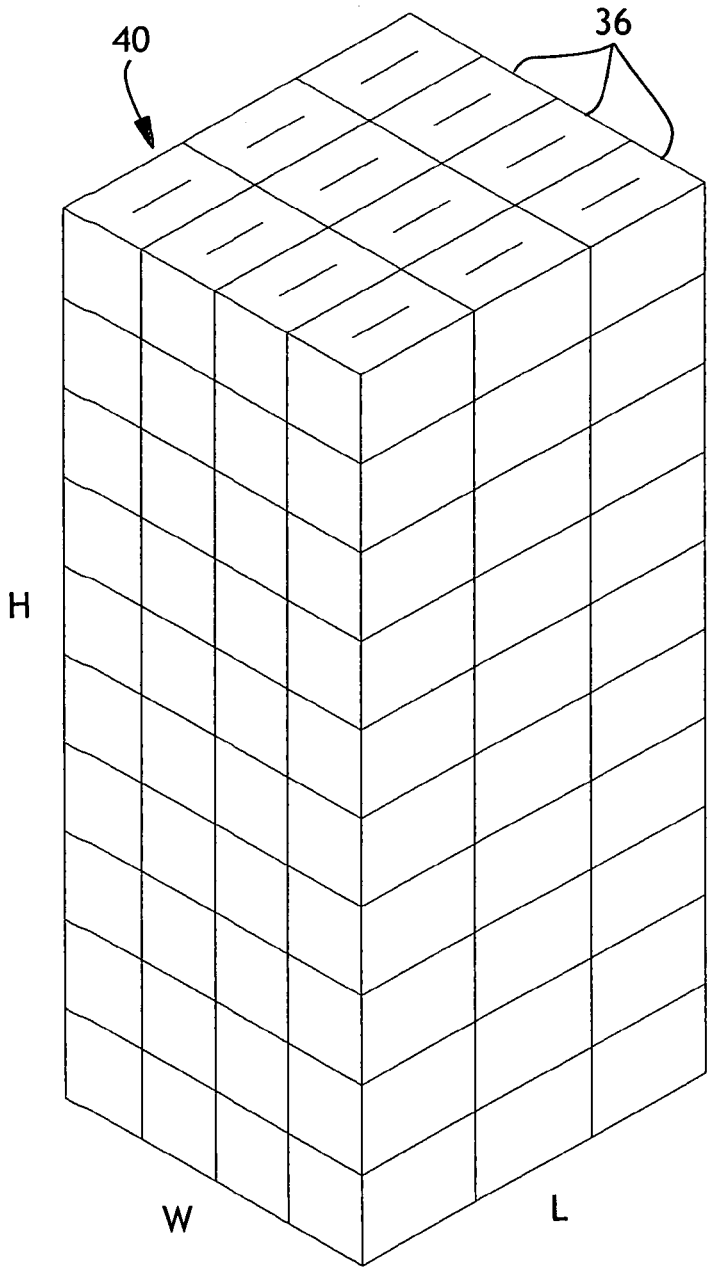
Figure 7B:
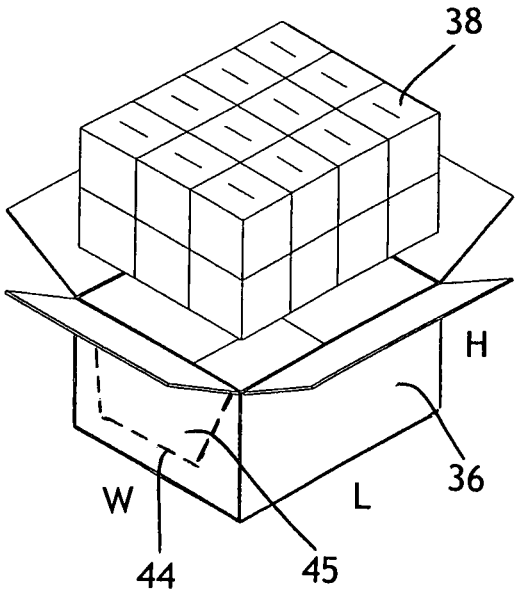

Referring now to FIGS. 6A-6C and 7A-7C, two possible shipping arrangements are shown for two differently sized triangular dispensers 10 of FIG. 2. In FIG. 6A, the length L is approximately 7.07 inches resulting in the other two sides of the dispenser being approximately 5 inches. In FIG. 7A, the length L is approximately 7.25 inches resulting in the other two sides of the dispenser being approximately 5.13 inches. FIGS. 6B and 7B show a plurality of interrelated triangular dispensers 10 disposed in a shipping box 36 or case.

Two (FIGS. 4B, 6A, 7A) or four (FIGS. 2B, 3B, 5B) of the dispensers can be interrelated to form a substantially parallelepiped shape. For example, two dispensers may be placed with their bottoms 16 adjacent to each other and then a band or a shrink wrap film 42 placed around the two dispensers to form a multi-pack bundle having a rectangular shape. Alternatively, a pressure sensitive adhesive 46 can be located on portions of one or more dispensers to form the multi-pack bundle.

The height, width, and depth of the shipping box 36 can be designed to pack different numbers of the dispensers or multi-pack bundles into the shipping box. In FIG. 6B, there are 24 dispensers packed into the shipping box 36 having a size of approximately 15.4 inches long, by 9.9 inches wide, by 10.75 inches high. In FIG. 7B, there are 48 dispensers packed into the shipping box 36 having a size of approximately 19.4 inches long, by 15.75 inches wide, by 11 inches high.

For each shipping box 36 illustrated, the fill efficiency of the shipping box is approximately 100 percent. As used herein, "fill efficiency" is the overall volume of the interrelated dispensers 38 prior to being put into the shipping box 36 divided by the interior volume of the shipping box times 100. In various embodiments of the invention, the fill efficiency can be between about 85 percent to about 100 percent, or between about 90 percent to about 100 percent, or between about 95 percent to about 100 percent, or between about 98 to about 100 percent.

To make a display ready shipping box to merchandise either the individual dispensers or the multi-pack bundles (2 or 4 individual dispensers banded, shrink wrapped, or adhesively secured together), the shipping box 36 can include a removable panel 45 formed by a weakened line 44 such as a plurality of perforations. In this manner, the dispensers or multi-pack bundles can be easily retrieved from the shipping box 36 without having to stock them on shelves at the retailer.

Figure 7C:
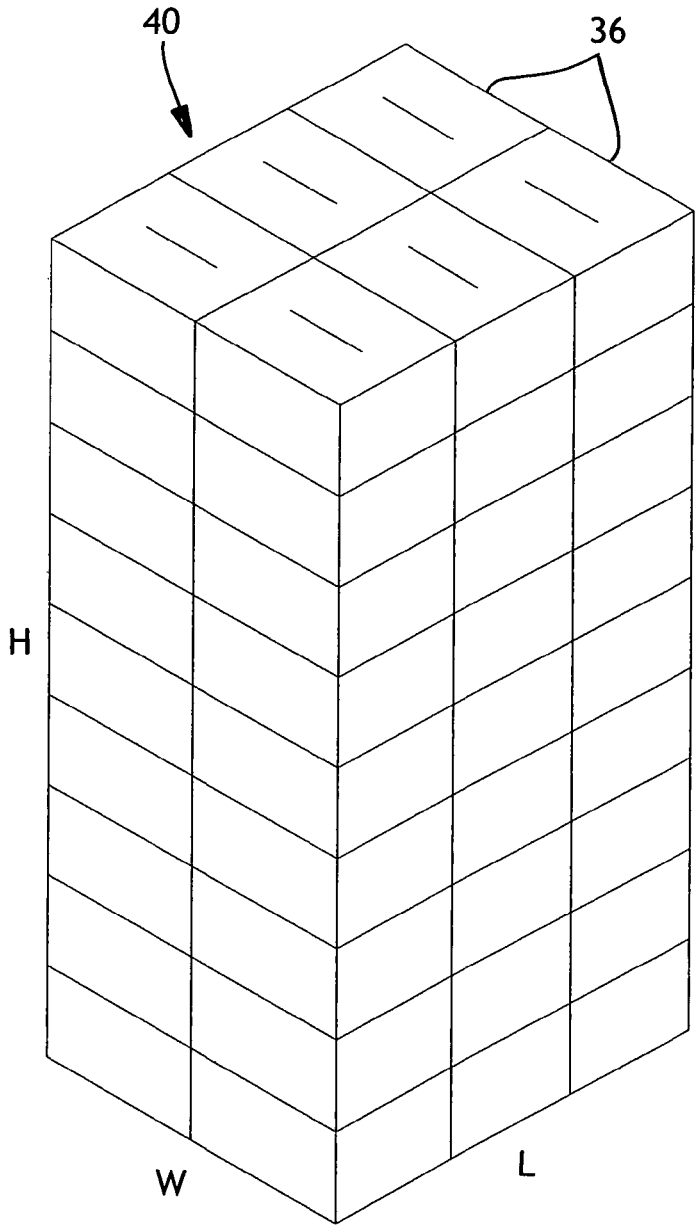

Referring to FIGS. 6C and 7C, a plurality of shipping boxes are arranged into a standard pallet sized footprint or pallet volume 40. The pallet volume 40 of the arrangement in FIG. 6C contains 2,880 triangular dispensers 10, having a size of approximately 46.1 inches long, 39.5 inches wide, and 107.5 inches high. The arrangement in FIG. 7C contains 2,592 triangular dispensers 10, having a size of approximately 47.25 inches long, 38.75 inches wide, and 99 inches high. For efficient loading onto an enclosed semi-trailer, the overall size of the size of the stacked shipping boxes 36, including any pallet, should be a maximum of approximately 48 inches long, by 40 inches wide, by 107 inches tall. In some cases, the pallet can be eliminated for lighter sheet-materials, such as facial tissue, and the shipping boxes stacked, shrink wrapped, and loaded by use of a clamp truck instead of a fork lift. Each pallet volume 40 has a corresponding pallet efficiency. As used herein "pallet efficiency" is the calculated pallet volume 40 divided by the theoretical maximum pallet volume (48×40×107) times 100. For FIG. 6C, the pallet efficiency is approximately 95 percent. For FIG. 7C, the pallet efficiency is approximately 88 percent. In various embodiments of the invention, the pallet efficiency can be between about 80 percent to about 100 percent, or between about 85 percent to about 100 percent, or between about 90 percent to about 100 percent, or between about 93 percent to about 100 percent.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising:

a shipping box containing a plurality of sheet-material dispensers;

the sheet-material dispensers housing a stack of sheets formed from a sheet-material, the dispenser comprising a top, a bottom, a first side wall, and a second sidewall, the first and second sidewalls comprising either a triangle, truncated triangle, or a trapezoid, said top comprising a dispensing opening;

wherein two or more sheet-material dispensers are interrelated within the shipping box to form a substantially rectangular prism shape; and wherein the shipping box comprises a fill efficiency, and the fill efficiency is between about 85 percent to about 100 percent.

2. The product of claim 1 wherein the dispenser comprises a triangular shape and the first and second sidewalls comprise an isosceles triangle having two 45 degree angles and one 90 degree angle, and the top comprises a first dispensing panel, a second dispensing panel, and a dispensing opening.

3. The product of claim 1 wherein the dispenser comprises a truncated triangular shape having one or more corners with an edge panel, and the first and second sidewall comprise a truncated isosceles triangle having two 45 degree angles and one 90 degree angle, and the top comprises a first dispensing panel, a second dispensing panel and a dispensing opening.

4. The product of claim 1 wherein the dispenser comprises a trapezoid shape and the first and second sidewalls comprise a trapezoid.

5. The product of claim 4 wherein the first and second sidewalls comprise a trapezoid having two 90 degree angles, one 45 degree angle, and one 135 degree angle, and the top comprises an angled dispensing panel having a dispensing opening.

6. The product of claim 2 wherein the stack comprises a bell-shaped stack.

7. The product of claim 3 wherein the stack comprises a bell-shaped stack.

8. The product of claim 2 wherein the shipping box comprises a fill efficiency, and the fill efficiency is between about 95 to about 100 percent.

9. The product of claim 3 wherein the shipping box comprises a fill efficiency, and the fill efficiency is between about 95 to about 100 percent.

10. The product of claim 4 wherein the shipping box comprises a fill efficiency, and the fill efficiency is between about 95 to about 100 percent.

11. The product of claim 1 wherein a plurality of shipping boxes are arranged into a pallet volume having a pallet efficiency, and the pallet efficiency is between about 80 to about 100 percent.

12. The product of claim 2 wherein a plurality of shipping boxes are arranged into a pallet volume having a pallet efficiency, and the pallet efficiency is between about 85 to about 100 percent.

13. The product of claim 3 wherein a plurality of shipping boxes are arranged into a pallet volume having a pallet efficiency, and the pallet efficiency is between about 85 to about 100 percent.

14. The product of claim 4 wherein a plurality of shipping boxes are arranged into a pallet volume having a pallet efficiency, and the pallet efficiency is between about 85 to about 100 percent.

15. The product of claim 3 wherein the dispenser comprises an edge panel located between the bottom and the first dispensing panel, an edge panel located between the bottom and the second dispensing panel, and an edge panel located between the first dispensing panel and the second dispensing panel.

16. The product of claim 1 wherein the shipping box comprises a display ready shipping box having a removable panel formed by a weakened line.

17. The product of claim 1 wherein the shipping box holds a plurality of multi-pack bundles comprising at least two dispensers secured together by a band, shrink wrap film, or adhesive to form a rectangular prism.

18. The product of claim 1 wherein the shipping box holds a plurality of multi-pack bundles comprising at least four dispensers secured together by a band, shrink wrap film, or adhesive to form a substantially rectangular prism shape.

19. The product of claim 1 wherein the stack comprises a bell-shaped stack and the sheets comprise facial tissue.

20. The product of claim 1 wherein the shipping box contains 24 dispensers.

21. The product of claim 1 wherein the shipping box contains 48 dispensers.

* * * * *